United States Patent [19]

Boettcher

[11] 4,312,460

[45] Jan. 26, 1982

[54] HELICAL VENDING MACHINE

[75] Inventor: William C. Boettcher, Foley, Mo.

[73] Assignee: D.O.V.E. Equipment Corporation, Winfield, Mo.

[21] Appl. No.: 139,991

[22] Filed: Apr. 14, 1980

Related U.S. Application Data

[63] Continuation-in-part of Ser. No. 35,421, May 2, 1979, Pat. No. 4,258,860.

[51] Int. Cl.[3] ..... G07F 11/36

[52] U.S. Cl. ..... 221/75; 221/242

[58] Field of Search ..... 221/75, 125, 129, 241, 221/242, 227, 230, 232; 194/10; 198/673

[56] References Cited

U.S. PATENT DOCUMENTS 2,818,165 12/1957 Dupps ..... 198/673

3,986,637 10/1976 Wittern et al. ..... 221/75

*Primary Examiner*—Stanley H. Tollberg

*Attorney, Agent, or Firm*—Gravely, Lieder & Woodruff

[57] ABSTRACT

This invention involves a vending machine having helix discharge units in which the rearmost convolution of the helix is retained by a clip and held off the floor of the unit to reduce friction and prevent excessive side-to-side movement of the rear of the helix. The units are used to store and dispense packaged objects such as chip products, candy, mints, chewing gum, candy bars, cigarettes, cigars, etc. The unit preferably utilizes a rotatable helix dispensing spindle having a central divider within the convolutions of the helix which can be adjusted by rotation from horizontal to vertical and which divides the helix into separate side-by-side compartments which can be varied in any size to accommodate different size packages. The size of the compartments is determined by the position of the center divider, the two compartments being largest when the divider is vertical and smallest when it is horizontal.

5 Claims, 10 Drawing Figures

FIG. 1
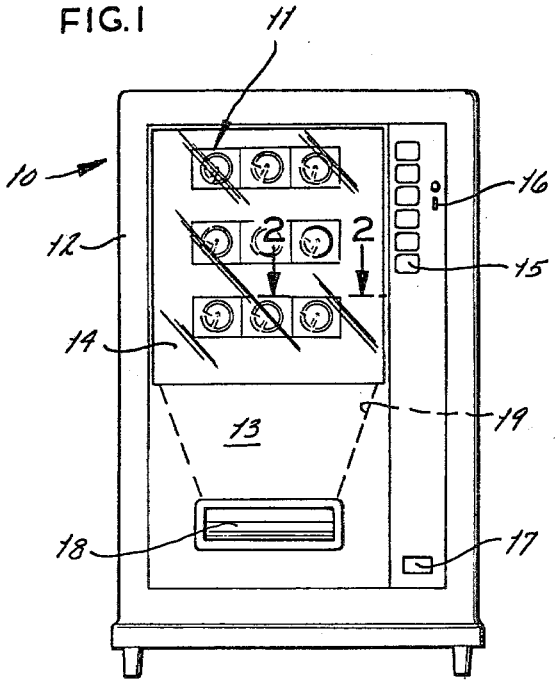
FIG. 2
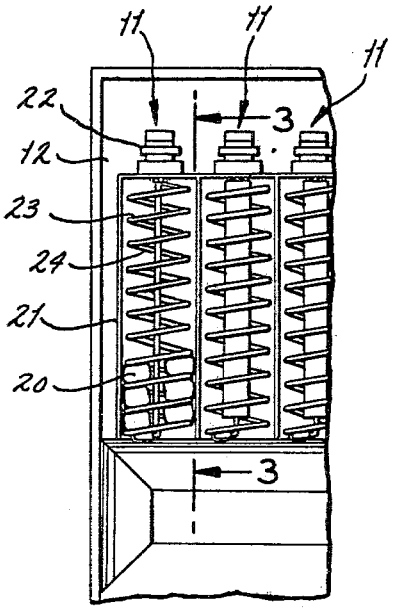
FIG. 3A
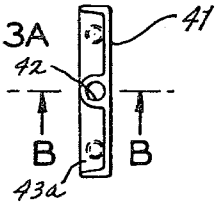
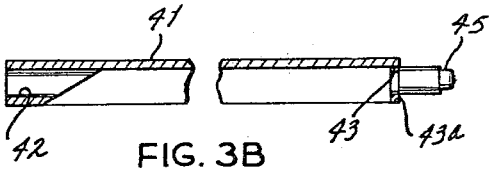
FIG. 3B
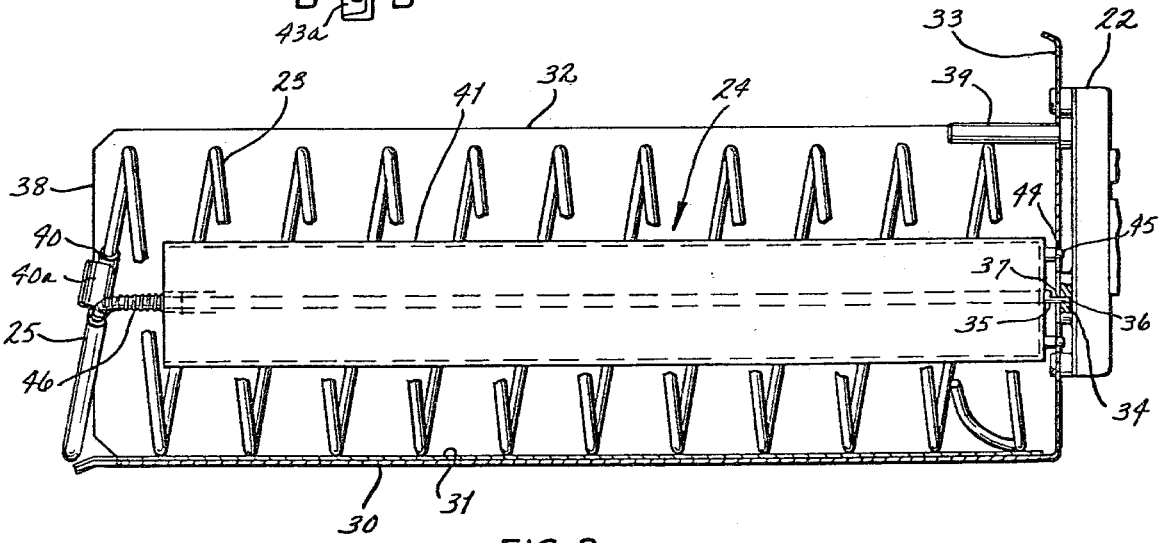
FIG. 3

HELICAL VENDING MACHINE

REFERENCE TO PRIOR APPLICATIONS

This application is a continuation-in-part of co-pending application Ser. No. 35,421, filed May 2, 1979 now U.S. Pat. No. 4,258,860, issued Mar. 31, 1980.

BACKGROUND OF THE INVENTION

This invention relates generally to vending machines and more particularly to those which utilize a helical coil to advance items from a storage position within the machine to a chute for discharge to the consumer. U.S. Pat. Nos. 3,178,055, 3,335,907, and 3,601,281 disclose various vending machines of this type. The machines usually have a discharge chute mounted on the front or at the side and are designed to hold a plurality of individual item discharge units. The units each have a tray with a helical coil mounted therein. Items are advanced by rotation of the coil by means of a motor activated by the customer after money is deposited in the machine.

In all devices of this type there are inherent problems of friction between the lower edges of the helical coils and the top surface of the trays in which the coils run. Also there are problems in maintaining the helical coils in a fixed relationship and in preventing side-to-side movement of the rear coils of the helix.

There have been different approaches to solving these problems, mainly applying some type of anti-friction coating, such as a smooth plastic tape, to the top surface of the tray.

Also support members have been inserted in the helices to keep the helices raised from the floor of the tray. A construction of this type is shown in Kenney U.S. Pat. No. 3,441,174.

Another problem in these vendors, which is addressed in Ser. No. 35,421, is that of providing different sized compartments in the units to accommodate different sized packages.

Economy of manufacture dictates that the individual units, and hence the trays, be of identical construction. The consumer, however, demands that a wide range of products be made available to him through vending machines. The size and shape of the packaging for these various products varies from the typical sack for potato chips and the like, to packages of various sizes of cigarettes, and to still other packages for thin or little cigars, mints, Lifesavers, gum and other products.

The problem for a manufacturer, therefore, is to provide a standard-sized tray, based quite often on a size necessary for vending cigarette packages, which is readily convertible to handling the smaller mint, gum, or candy bar packages.

While there are various methods for changing the size of the compartments, these earlier devices all result in compartments of fixed size, so that if the operator of the machine wished to change the size on site he needs to disassemble part or all of the unit and possibly has to take the unit back to his base of operations. It is quite desirable that a method be provided for adjusting the size of the units at the site, so that popular items can be included in a particular machine even if they happen to differ in size from the items currently vended from the machine.

Among the patents which have attempted to utilize a spacer of some sort to reduce the size of the compartments are Whistin U.S. Pat. Nos. 3,908,858, and Wittern 3,929,255. However, neither of these units is completely adjustable on site and does not achieve all of the objects and advantages of the present invention.

Accordingly, it is a principal object of the present invention to provide a helical vending unit in which the rearward convolutions of the helix are held off the floor of the tray in which the helix is running, and further are restrained from excessive sidewise movement in the tray.

It is a further object to provide said helix restraint in combination with a preferred embodiment of the helix and an adjustable divider positioned within the helix to change the size of the merchandise compartments encompassed by the helix and a tray in which the helix runs.

These and other objects and advantages will become apparent hereinafter.

SUMMARY OF THE INVENTION

The present invention comprises a vending machine unit in which a helix turns in a tray to progress items toward the open end of the tray and means for restraining the rearmost convolution of the helix to hold at least a portion of the helix off the tray floor. Preferably the helix restraint is used in combination with an adjustable divider means within the helix to change the spacing between the side walls of the tray and the edges of said divider, whereby articles of different widths can be accommodated in the convolutions of the helix.

In the drawings wherein like numbers refer to like parts wherever they occur:

FIG. 1 is a front elevational view showing a vending machine having individual units incorporated therein:

FIG. 2 is a sectional view taken along line 2—2 of FIG. 1 showing several of the individual vend units in plan;

FIG. 3 is a vertical sectional view taken along line 3—3 of FIG. 2;

FIG. 3A is an end view of the shelf;

FIG. 3B is a foreshortened sectional view of the shelf of FIG. 3A taken along line B—B of FIG. 3A;

Figure 4:
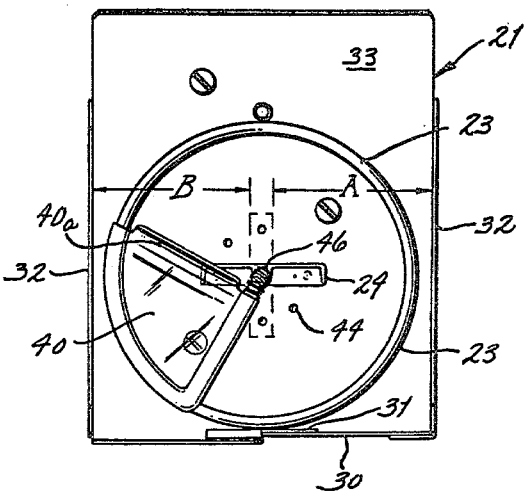
FIG. 4 is an end elevational view of a single dispensing module shown in FIG. 3 with the shelf in a horizontal position.
Figure 5:
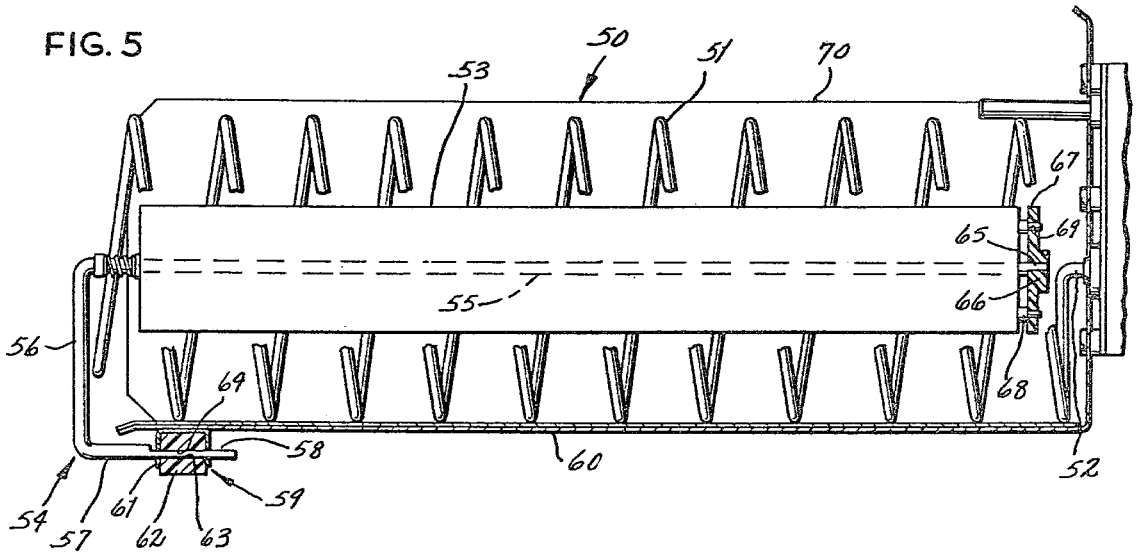
FIG. 5 is a plan view of a modification of the present invention utilizing a rear drive for the helix.
Figure 6:
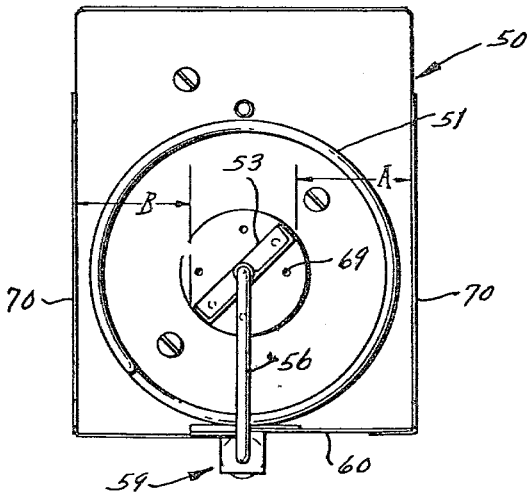
FIG. 6 is an end elevational view of the modification shown in FIG. 5.
Figure 7:
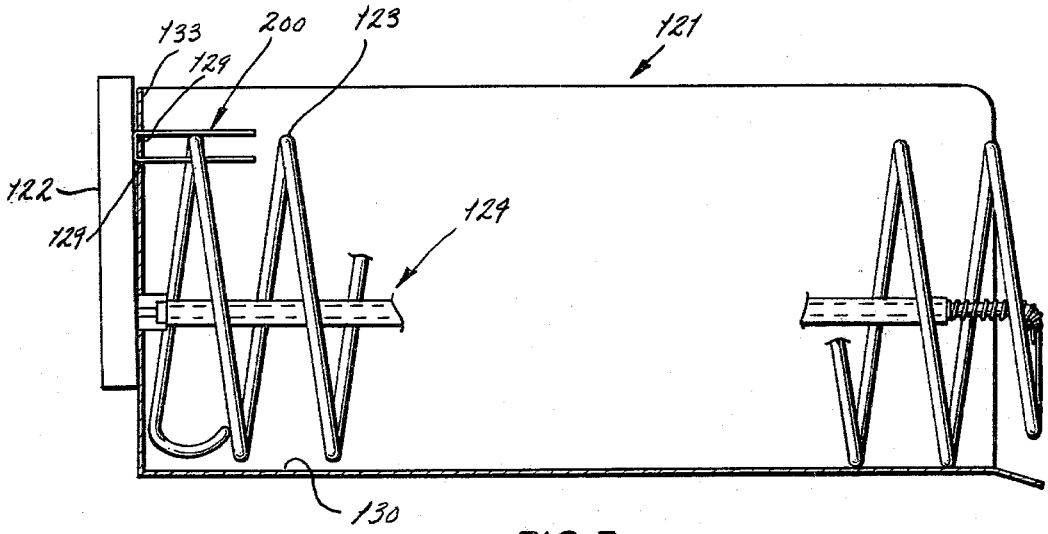
FIG. 7 is a vertical sectional view showing a preferred restraining clip in combination with a helix having an adjustable shelf as shown in FIGS. 1–6.
Figure 8:
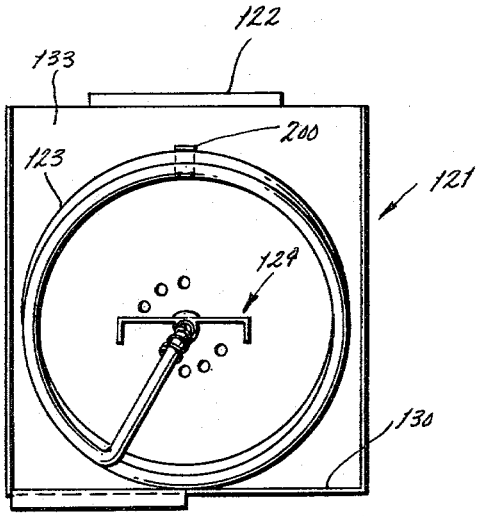
FIG. 8 is an end view of the helix and tray shown in FIG. 7.

A preferred embodiment of the present invention is shown in FIGS. 7 and 8. In this embodiment, the helix 123 is front end driven as described in FIGS. 1–4 in Ser. No. 35,421. The helix 123 also could be rear driven as shown in FIGS. 5 and 6 of Ser. No. 35,421. Positioned between the motor or drive unit 122 and the rear wall 133 of the tray assembly 121 is a retaining clip 200. The clip 200 is "U"-shaped and the arms of the "U" pass through openings 129 in the tray rear wall 133 and embrace the rearmost convolution of the helix 123 as it is most spaced from the tray floor 130. The bight of the "U" is fixed between the drive unit 122 and the tray rear wall 133 by means of fastening members (not shown). The clip arms have sufficient width to engage the helix 123 at two points to lift the helix 123 above the tray floor 130 and to restrict sidewise movement of the rear end of the helix 123. The clip also can have a radius conforming to the helix or can be a bar of sufficient strength to support the helix.

As seen in FIG. 7, the convolutions of the helix 123 slope from the rear to the front of the tray 131 and the leading helix convolutions may engage the tray floor 130.

In the preferred embodiment, the tray 121 is provided with an adjustable divider 124 which is the subject matter of Ser. No. 35,421 and which will be described hereinafter in detail in conjunction with the description of FIGS. 1–6.

In the vend units shown in FIGS. 1–6, the helix is restrained by being held against the floor of the tray by the pin 39 which prevents products being vended from being driven beneath the helix. This was used in combination with a friction reducing teflon tape 31 positioned along the tray floor. We now have found that lifting the helix and restraining its side to side motion is a more efficient way of reducing friction and preventing packages from jamming the vendor.

Following is a description of the devices shown in FIGS. 1–6 essentially as described in Ser. No. 35,421. The bracket 200 is suitable for use in these embodiments and requires only the removal of pin 39 and replacement with the "U" shaped retainer 200. The retainer 200 is, of course, also applicable to helix delivery systems which do not use an adjustable divider.

The present invention is embodied in a vending machine 10 (FIG. 1) having a plurality of helix discharge units indicated generally by the numeral 11 which preferably are disposed in side by side horizontal and/or vertical relationship within the storage compartment portion of the machine 10. If desired, the units 11 can be used individually, but the more usual arrangement is a bank within a cabinet 12 as shown. The cabinet or storage compartment 12 includes a front door 13 having a clear see-through window portion 14 through which the customer may view the merchandise residing in the units 11. Mounted on the machine 10 are selection means 15 which activate the individual units 11, a coin slot 16 and a coin return 17. A discharge opening 18 positioned at the lower portion of the door 13 is connected to a discharge chute 19 which connects with the open front end of the vend units 11.

A plurality of packaged items 20, such as rolls of mints, packages of gum, or the like are positioned within each helix discharge unit 11 (FIG. 2). The discharge units 11 are designed so that they can be moved into or out of the cabinet 12 for refilling. Each of the units 11 is similar and preferably comprises a tray assembly 21, a drive unit 22, a helix 23, and an adjustable divider mechanism 24.

In the form of the invention shown in FIGS. 1–4, the helix 23 is known as a front driven helix which means that there is a positive connection between the drive means 22 and the leading edge 25 of the helix 23.

The tray assembly 21 comprises a bottom wall 30, which preferably has a plastic layer 31 of Teflon or the like positioned along the upper side of the bottom wall 30 so that the helix 23 rotates on the sheet 31. This protects the surface of the bottom wall 30, which may be painted, and also acts as a friction and power consumption reducing element for the helix 23.

The tray assembly unit 21 further comprises side walls 32 and a rear wall 33. The drive unit 22 is attached to the back side of the rear wall 33 and has a drive shaft 34 in which a drive rod 35 is positioned and caused to rotate therewith by means of flattened surfaces 36 and 37. The drive rod is an extension of the leading edge of the helix 23 and is enclosed in the divider unit 24. Thus, when the drive unit 22 is energized, the drive shaft 34 rotates the drive rod 35 and consequently the leading edge 25 of the helix 23 is rotated to propel the packages 20 stored within the convolutions of the helix 23 toward the open end 38 of the tray assembly 21. The outermost package 20 is propelled out of the tray assembly 21 into the discharge chute 19. The unit is set up so that a package is discharged with each 180° rotation of the helix 23.

A small diameter dowl pin 39 is positioned in the rear wall 33 and extends slightly above the rear end of the helix 23. The pin 39 extends sufficiently forward to extend over the last convolution of the helix 23 when said last convolution is at its forwardmost progression. The pin 39 acts to keep the rear of the helix 23 down against the tray floor 30 to prevent products from being driven beneath the helix 23, thus jamming the vending system.

A clear plastic member 40 is positioned in the last quadrant of the helical member 23 to aid in locating the drive rod 35 in the center of the helix 23. The member 40 has an outturned lip 41 to cam the last package backward toward the helix to prevent small packages from becoming wedged in the discharge mechanism, thus causing the machine to become inoperative.

The divider 24 is incrementally adjustable between horizontal and vertical positions so as to provide a means for adjusting the width of the side by side compartments A and B defined between the divider 24 and the tray side walls 32. The divider mechanism 24 comprises a U-shaped rectangular body 41, preferably formed from plastic or other suitable material. The drive rod 35 is positioned within the center of the divider body 41 and is journaled in a retaining member 42 on the leading edge and in an opening 43 in a rear wall 43*a* of the divider body 41. The openings 42 and 43 cradle and retain the drive rod 35 in the body 41 and act as bearing surfaces for rotation of the body 41 about the rod 35.

Positioned at or within the tray rear wall 33 are spaced opposed openings 44 which will align with locating pin means 45 positioned at the rear edge of the divider body 41. A spring 46 or like resilient means is disposed between the front edge of the divider body 41 and the clear plastic member 40 surrounding the drive rod 35. The spring 46 urges the divider body 41 toward the rear wall 33 and maintains the divider body 41 positioned in engagement with the openings 44 to secure the divider 41 in fixed position with respect to the rear wall 33.

To adjust the position of the divider body 41, the divider body 41 first is pulled forward, withdrawing the studs 45 from the openings 44 against the pressure of the spring 46. The divider body 41 then is rotated until the studs 45 are in alignment with a second set of openings 44. The final step in adjusting the body 41 is reengaging the studs 45 with such second set of openings 44. Thus, the divider mechanism 24 has effectively changed the size of the openings A and B between the edges of the divider body 41 and the tray side walls 32, so that a different size package can be accommodated between the convolutions of the helix 23.

A modification of the invention is shown in FIGS. 5 and 6 and comprises a tray 50 having a helix 51 which is driven from the rear by means of a drive rod 52 which is an extension of the last coil of the helix 51. To support a divider body 53, a U-shaped support member 54 is mounted on the tray 50. The support member 54 comprises an elongated upper leg 55, a bight portion 56 and a lower leg 57 having a flattened portion 58 adjacent to the free end. A support member 59 is mounted beneath the tray floor 60, and comprises a bracket 61 containing a synthetic polymeric retainer member 62. The retainer member 62 has an opening 63 therein with a flattened portion 64 which frictionally mates with the flattened portion 58 of the support leg 57 to fixedly mount the support member 54 and the adjustable divider 53 to the tray 50. Any suitable support means can be used to connect the tray 50 to the shelf divider 53.

The elongated leg 55 of the support member 54 has a reduced section 65 at its free end which is engaged with central hub 66 of a nonrotating lock member 67 to fix the position of the support leg 55 with respect to the tray 50. The divider body 53 is provided with studs 68 which project outwardly from the trailing edge thereof to engage openings 69 positioned within the periphery of the nonrotating lock member 67 to fix the position divider body 53 with respect to the tray 50. Thus if the divider studs 68 are withdrawn from the lock wheel openings 69 and the body 53 is rotated around the elongated leg 55 of the support member 54, the effective width of the divider member 53 is changed, so as to change the distance between the edges thereof and the tray side walls 70. This changes the size of the compartment A and B defined between the divider 53 and the tray side walls 70.

What is claimed:

1. A vending machine item discharge unit comprising:

(a) a tray means having side, rear and bottom walls, (b) helical means having a plurality of convolutions along its length to retain articles to be dispensed in the convolutions, (c) drive means connected to the helical means to rotate said helical means in predetermined increments upon activation by a customer, and (d) restraining means positioned within the helix and being of sufficient width to engage the underside of the rearmost convolution of the helix at two points as the helix is at the apex of its rotation and is most spaced from the bottom wall of the tray to hold the said rearmost convolution above the bottom wall of the tray to reduce friction therebetween and to restrict sidewise movement of the rear end of the helix.

2. The unit of claim 1 wherein the restraining means is a substantially "U" shaped bracket with the arms of the "U" engaging the rearmost convolution at the highest part of its rotation.

3. The unit of claim 1 wherein the restraining means has arms which embrace the rearmost convolution of the helix adjacent to its highest point in its rotation to retain the helix off the tray floor and the restraining means is fixed with relation to the rear wall of the tray.

4. The unit of claim 1 including adjustable means positioned within the helical means and movable to change the size of the article receiving area in each of the convolutions whereby articles of different widths can be contained in the convolutions of the helix.

5. The unit of claim 2 wherein the bight of the "U" is positioned behind the rear wall of the tray and the arms of the "U" pass through openings in said rear wall.

* * * * *